US006134404A

United States Patent [19]

Iwai et al.

[11] Patent Number: 6,134,404

[45] Date of Patent: Oct. 17, 2000

[54] SHEET PROCESSING APPARATUS HAVING A SHEET TRANSPORT PATH

[75] Inventors: Hiroji Iwai; Hideo Yoshikawa; Akihiro Tanaka, all of Yamatokoriyama, Japan

[73] Assignee: Sharp Kabushiki Kaisha, Osaka, Japan

[21] Appl. No.: 09/348,877

[22] Filed: Jul. 7, 1999

[30] Foreign Application Priority Data

Jul. 14, 1998 [JP] Japan ..... 10-198550

[51] Int. Cl.[7] ..... G03G 15/00

[52] U.S. Cl. ..... 399/110; 399/124

[58] Field of Search ..... 399/21, 107, 110, 399/113, 124, 125, 401

[56] References Cited

U.S. PATENT DOCUMENTS 5,255,061 10/1993 Matsuura et al. ..... 399/124
5,614,992 3/1997 Kikuchi et al. ..... 399/124

FOREIGN PATENT DOCUMENTS 818724 2/1996 Japan .

*Primary Examiner*—William J. Royer
*Attorney, Agent, or Firm*—Birch, Stewart, Kolasch & Birch, LLP

[57] ABSTRACT

A sheet processing apparatus containing: a paper feed portion; a processing portion; a paper output portion; a paper transport path defined from the paper feed portion to the paper output portion by way of the processing portion, by components arranged opposing both sides or surfaces of a paper sheet to be transported; and a side panel cover, which is integrated with the components opposing one of the paper sheet's surfaces on one side of an apparatus body, being among the components constituting the paper transport path, wherein the side panel cover is adapted to move horizontally with respect to the apparatus body; wherein the paper transport path includes a primary transport path defined from the paper feed portion to the paper output portion by way of the processing portion, by components opposing both sides or surfaces of the paper sheet to be transported, and an auxiliary transport path defined from the paper output portion to the paper feed portion, by components opposing both sides or surfaces of the paper to be transported; and wherein the side panel cover is integrated with either the components opposing the paper sheet's sides or surfaces on one side of the apparatus body, being among the components constituting the primary transport path, or the components opposing the paper sheet's sides or surfaces on one side of the apparatus body, being among the components constituting the auxiliary transport path.

21 Claims, 8 Drawing Sheets

SHEET PROCESSING APPARATUS HAVING A SHEET TRANSPORT PATH

BACKGROUND OF THE INVENTION (1) Field of the Invention

The present invention relates to a sheet processing apparatus such as an image forming apparatus and the like having a sheet transport path, defined by the components which oppose either the obverse side or underside of a sheet-like paper, from a sheet feeder to a sheet output by way of a processor. In particular, the invention relates to a sheet processing apparatus having a configuration allowing for exposure of the sheet transport path to the outside of the apparatus in order to enable access to sheets in the case of sheet jamming or the like.

(2) Description of the Prior Art

There are sheet processing apparatuses such as image forming apparatuses, e.g., printer, copier and the like, which have a sheet transport path for conveying sheet-like paper from a sheet feeder to a sheet output by way of a processor whilst subjecting the sheet being conveyed along the sheet transport path to a predetermined process. In such sheet processing apparatuses, there are cases where the sheet being conveyed along the sheet transport path accidentally jams. In order to prevent reduction in operating efficiency of the sheet processing apparatus, it is necessary to enable quick and effective removal of the jammed paper from the sheet transport path.

For this purpose, there is a conventional sheet processing apparatus as shown in FIG. 1. In this configuration, an apparatus 200 has a side panel cover 201 on one side which is pivotally supported by a hinge 202 located on the rear side, and this side panel cover 201 has a component 203*a* fixed thereon which is one of the constituents of a paper transport path 203 and opposes one side of the sheet to be conveyed. Further, when side panel cover 201 is rotated outward with respect to apparatus 200, paper transport path 203 is made open. An example of component 203*a* constituting one side of paper transport path 203 is a transfer charger when the sheet processing apparatus is an image forming apparatus.

Japanese Patent Publication Hei 8 No. 18,724 discloses an image forming apparatus including a primary transport path for conveying a paper from a paper feeder to the paper output by way of a processor and an auxiliary transport path for inverting the paper, upside down in the apparatus so as to allow for duplex image forming on one sheet of paper. This apparatus comprises: a first unit having a side panel cover on one side thereof rotatably hinged at its bottom and being integrally provided with components opposing one side of the paper in the auxiliary transport path; and a second unit rotatably hinged at its bottom integrally having components opposing the other side of the paper in the auxiliary transport path and components opposing one side of the paper in the primary transport path, and arranged together with, or separately from, the first unit.

In accordance with the above conventional sheet processing apparatus, the component opposing one side of the paper in the paper transport path is rotated outward together with the side panel cover of the apparatus so as to open the paper transport path, thus allowing for easy removal of the jammed paper from the paper transport path.

However, in the conventional sheet processing apparatus shown in FIG. 1, in order to expose the entire part of paper transport path 203 to the outside, the width of side panel cover 201 rotatably arranged with respect to apparatus 200 needs to be at least greater than the width of the paper, perpendicular to the conveyed direction of the paper. Therefore, side panel cover 201 projects out a large amount from the side of apparatus 200, giving rise to a necessity of providing a large space for installation. Since component 203*a* which defines paper transport path 203 projects from the inner surface of side panel cover 201, when side panel cover 201 is rotated to the opened position, part of component 203*a* is located close to part of paper transport path 203 on the rear side, which gives rise to difficulties in removal of the paper from paper transport path 203 due to its interference with component 203*a* constituting paper transport path 203. Further, when a manual feeder tray 204 is attached to the side face of apparatus 200 for allowing manual paper feeding, manual feeder tray 204 projects to the rear when side panel cover 201 is rotated. Therefore, there is a need to provide enough space also on the rear side of apparatus 200, further increasing the space for installation.

In the configuration disclosed in Japanese Patent Publication Hei 8 No. 18,724, the first and second units are rotated relative to the apparatus about the hinge at the bottom thereof so as to release the primary and auxiliary transport paths. Therefore, the open amount is smaller on the lower side of the primary and auxiliary transport paths compared to that on the upper side, giving rise to difficulties in removing the paper jammed in the lower side of the primary and auxiliary transport paths. In particular, when the manual feeder tray is attached to the side face of the apparatus, the range of rotation of the first and second units is limited by the abutment between the manual feeder tray and the floor. Therefore, it is impossible to have a large angle of rotation of the first and second units relative to the apparatus, thus making more difficult the removal of the paper from the lower side of the primary and auxiliary transport paths.

Consequently, the conventional sheet processing apparatuses have suffered from inability of easy removal of jams without the necessity of providing a large space for installation of the apparatus.

SUMMARY OF THE INVENTION

It is therefore an object of the present invention to provide a sheet processing apparatus wherein components opposing one side of the paper in the paper transport path are integrally fixed to one side panel cover, which is moved horizontally relative to the apparatus so as to open the paper transport path and allow for easy removal of jammed sheets without the necessity of providing a large space for installation of the apparatus.

In order to achieve the above object, the present invention is configured as follows:

In accordance with the first aspect of the present invention, a sheet processing apparatus includes: a paper feed portion; a processing portion; a paper output portion; a paper transport path defined from the paper feed portion to the paper output portion by way of the processing portion, by components arranged opposing both sides of sheet-like paper to be transported; and a side panel cover which is integrated with the components opposing the paper surface on one side of the apparatus body, being among the components constituting the paper transport path, and is constructed so that the side panel cover is adapted to move horizontally with respect to the apparatus body.

In accordance with the second aspect of the present invention, the sheet processing apparatus having the above first feature is constructed so that the paper transport path includes a primary transport path defined from the paper feed portion to the paper output portion by way of the processing portion, by components opposing both sides of the paper to be conveyed, and an auxiliary transport path defined from the paper output portion to the paper feed portion, by components opposing both sides of the paper to be conveyed; and the side panel cover is integrated with either the components opposing the paper surface on one side of the apparatus body, being among the components constituting the primary transport path, or the components opposing the paper surface on one side of the apparatus body, being among the components constituting the auxiliary transport path.

In accordance with the third aspect of the present invention, the sheet processing apparatus having the above first feature, is constructed so that the side panel cover is movable in the horizontal direction and vertical direction relative to the apparatus body.

In accordance with the fourth aspect of the present invention, the sheet processing apparatus having the above second feature, is constructed so that the side panel cover is movable in the horizontal direction and vertical direction relative to the apparatus body.

In accordance with the fifth aspect of the invention, the sheet processing apparatus having the above third feature is constructed so that the paper transport path includes a primary transport path defined from the paper feed portion to the paper output portion by way of the processing portion by components opposing both sides of the paper to be conveyed and an auxiliary transport path disposed closer to one side of the apparatus body with respect to the primary transport path and defined from the paper output portion to the paper feed portion, by components arranged opposing both sides of the paper to be conveyed; the components opposing the paper surface on one side of the apparatus body, being among the components constituting the primary transport path and the components constituting the auxiliary transport path are integrated with the side panel cover and are arranged movable horizontally and vertically relative to the apparatus body; the components opposing the paper surface on one side of the apparatus body, being among the components constituting the primary transport path and the components opposing the paper surface on the other side of the apparatus body, being among the components constituting the auxiliary transport path are integrally axially supported at an axle located in the lower end portion.

In accordance with the sixth aspect of the present invention, the sheet processing apparatus having the above fourth feature is constructed so that the paper transport path includes a primary transport path defined from the paper feed portion to the paper output portion by way of the processing portion by components opposing both sides of the paper to be conveyed and an auxiliary transport path disposed closer to one side of the apparatus body with respect to the primary transport path and defined from the paper output portion to the paper feed portion, by components arranged opposing both sides of the paper to be conveyed; the components opposing the paper surface on one side of the apparatus body, being among the components constituting the primary transport path and the components constituting the auxiliary transport path are integrated with the side panel cover and are arranged movable horizontally and vertically relative to the apparatus body; and the components opposing the paper surface on one side of the apparatus body, being among the components constituting the primary transport path and the components opposing the paper surface on the other side of the apparatus body, being among the components constituting the auxiliary transport path are integrally axially supported at an axle located in the lower end portion.

In accordance with the seventh aspect of the present invention, the sheet processing apparatus having the above first feature is constructed so that the paper transport path is formed approximately vertically between the paper feed portion and the paper output portion, which are arranged vertically in the apparatus body with the processing portion in between, so as to be arranged by way of one side of the processing portion.

In accordance with the eighth aspect of the present invention, the sheet processing apparatus having the above second feature is constructed so that the paper transport path is formed approximately vertically between the paper feed portion and the paper output portion, which are arranged vertically in the apparatus body with the processing portion in between, so as to be arranged by way of one side of the processing portion.

In accordance with the ninth aspect of the present invention, the sheet processing apparatus having the above third feature is constructed so that the paper transport path is formed approximately vertically between the paper feed portion and the paper output portion, which are arranged vertically in the apparatus body with the processing portion in between, so as to be arranged by way of one side of the processing portion.

In accordance with the tenth aspect of the present invention, the sheet processing apparatus having the above fourth feature is constructed so that the paper transport path is formed approximately vertically between the paper feed portion and the paper output portion, which are arranged vertically in the apparatus body with the processing portion in between, so as to be arranged by way of one side of the processing portion.

In accordance with the eleventh aspect of the present invention, the sheet processing apparatus having the above fifth feature is constructed so that the paper transport path is formed approximately vertically between the paper feed portion and the paper output portion, which are arranged vertically in the apparatus body with the processing portion in between, so as to be arranged by way of one side of the processing portion.

In accordance with the twelfth aspect of the present invention, the sheet processing apparatus having the above sixth feature is constructed so that the paper transport path is formed approximately vertically between the paper feed portion and the paper output portion, which are arranged vertically in the apparatus body with the processing portion in between, so as to be arranged by way of one side of the processing portion.

In accordance with the thirteenth aspect of the present invention, the sheet processing apparatus having the above seventh feature is constructed so that the processing portion is an image forming portion for forming images on one or both sides of the paper.

In accordance with the fourteenth aspect of the present invention, the sheet processing apparatus having the above eighth feature is constructed so that the processing portion is an image forming portion for forming images on one or both sides of the paper.

In accordance with the fifteenth aspect of the present invention, the sheet processing apparatus having the above ninth feature is constructed so that the processing portion is an image forming portion for forming images on one or both sides of the paper.

In accordance with the sixteenth aspect of the present invention, the sheet processing apparatus having the above tenth feature is constructed so that the processing portion is an image forming portion for forming images on one or both sides of the paper.

In accordance with the seventeenth aspect of the present invention, the sheet processing apparatus having the above eleventh feature is constructed so that the processing portion is an image forming portion for forming images on one or both sides of the paper.

In accordance with the eighteenth aspect of the present invention, the sheet processing apparatus having the above twelfth feature is constructed so that the processing portion is an image forming portion for forming images on one or both sides of the paper.

In accordance with the nineteenth aspect of the present invention, the sheet processing apparatus having the above thirteenth feature is constructed so that the paper transport path is defined by the gap between a photoreceptor and a transfer device in the image forming portion and a pair of rollers constituting a fixing unit, and the transfer device and one of the rollers constituting the fixing unit are affixed on the side panel cover.

In accordance with the twentieth aspect of the present invention, the sheet processing apparatus having the above fourteenth feature is constructed so that the paper transport path is defined by the gap between a photoreceptor and the transfer device in the image forming portion and a pair of rollers constituting a fixing unit, and the transfer device and one of the rollers constituting the fixing unit are affixed on the side panel cover.

In accordance with the twenty-first aspect of the present invention, the sheet processing apparatus having the above fifteenth feature is constructed so that the paper transport path is defined by the gap between the photoreceptor and the transfer device in the image forming portion and a pair of rollers constituting a fixing unit, and the transfer device and one of the rollers constituting the fixing unit are affixed on the side panel cover.

In accordance with the twenty-second aspect of the present invention, the sheet processing apparatus having the above sixteenth feature is constructed so that the paper transport path is defined by the gap between the photoreceptor and the transfer device in the image forming portion and a pair of rollers constituting a fixing unit, and the transfer device and one of the rollers constituting the fixing unit are affixed on the side panel cover.

In accordance with the twenty-third aspect of the present invention, the sheet processing apparatus having the above seventeenth feature is constructed so that the paper transport path is defined by the gap between the photoreceptor and the transfer device in the image forming portion and a pair of rollers constituting a fixing unit, and the transfer device and one of the rollers constituting the fixing unit are affixed on the side panel cover.

In accordance with the twenty-fourth aspect of the present invention, the sheet processing apparatus having the above eighteenth feature is constructed so that the paper transport path is defined by the gap between the photoreceptor and the transfer device in the image forming portion and a pair of rollers constituting a fixing unit, and the transfer device and one of the rollers constituting the fixing unit are affixed on the side panel cover.

According to the first aspect of the invention, among the components arranged on both sides of the paper from the paper feed portion to the paper output portion by way of the processing portion, the components opposing one side of the paper are adapted to move horizontally together with the side panel cover with respect to the apparatus body. Accordingly, when the side panel cover is moved horizontally relative to the apparatus body, the components constituting one side of the paper transport path can be separated horizontally from the components on the other side, thus making it possible to open the paper transport path across substantially its entire surface to a predetermined distance.

According to the second aspect of the invention, either the components on one side, being among the components constituting the primary transport path, arranged on both sides of the paper from the paper feed portion to the paper output portion by way of the processing portion, or the components on one side, being among the components constituting the auxiliary transport path, arranged on both side of the paper from the paper output portion to the paper feed portion, are adapted to move horizontally together with the side panel cover with respect to the apparatus body. Accordingly, when the side panel cover is moved horizontally relative to the apparatus body, the components constituting one side of the primary transport path or auxiliary transport path can be separated in the horizontal direction from the components on the other side, thus making it possible to open the primary transport path or the auxiliary transport path, across substantially its entire surface to a predetermined distance.

According to the third and fourth aspects of the invention, the components constituting one side of the paper transport path are integrated with the side cover panel and is configured to be movable in the horizontal direction and vertical direction relative to the apparatus body. Accordingly when the side panel cover is moved in the horizontal and vertical directions relative to the apparatus body, the components constituting one side of the paper transport path can be separated horizontally and vertically from the components on the other side, thus completely opening the paper transport path in a manner so that the components on one side will not oppose the components on the other side.

According to the fifth and sixth aspects of the invention, the components constituting one side of the primary transport path and the components constituting the auxiliary transport path are adapted to move together with the side panel cover horizontally and vertically relative to the apparatus body while the components constituting one side of the primary transport path and the components constituting the other side of the auxiliary transport path are axially supported integrally at an axle located in the lower portion. Accordingly when the side panel cover is moved horizontally and vertically relative to the apparatus body, the components constituting one side of the primary transport path can be separated horizontally and vertically from the components on the other side, thus completely opening the primary transport path in a manner so that the components on one side will not oppose the components on the other side. Further, in the side panel cover, when the components constituting one side of the primary transport path and the components constituting the other side of the auxiliary transport path are integrally rotated at the axle located in the lower portion, the components constituting the other side of the auxiliary transport path can be separated from the components on one side to thereby open the auxiliary transport path.

According to the seventh through twelfth aspects of the invention, the paper feed portion and the paper output portion are arranged vertically with the processing portion in between in the apparatus body so as to configure a paper transport path extending approximately vertically from the paper feed portion to the paper output portion by way of one side of the processing portion. Accordingly, the paper transport path is formed near one side panel cover of the apparatus substantially parallel thereto and the paper feed portion, processing portion, paper output portion and paper transport path are laid out in optimal positions in the apparatus body in order to allow one side of the components constituting the paper transport path to be moved together with the side panel cover with respect to the apparatus body.

According to the thirteenth through eighteenth aspects of the invention, images are formed by the processing portion, i.e., the image forming portion, on one side or both sides of the paper being conveyed from the paper feed portion to the paper output portion along the paper transport path. Therefore, when the side panel cover is moved relative to the apparatus body to open the paper transport path, the paper jammed in the paper transport path before and after the one-side or duplex image forming process can be exposed to the outside.

According to the nineteenth through twenty-fourth aspects of the invention,in the apparatus body, the paper transport path from the paper feed portion to the paper output portion is formed by the gap between the photoreceptor and the transfer device and a pair of rollers constituting a fixing unit, and the transfer device and one of the rollers constituting the fixing unit are affixed on the side panel cover. Therefore, when the side panel cover is moved relative to the apparatus body, the transfer device and one roller of the fixing unit are separated from the photoreceptor and the other roller of the fixing unit so as to create open space between the photoreceptor and transfer device and between the pair of rollers of the fixing unit, along the paper transport path.

DESCRIPTION OF THE PREFERRED EMBODIMENT

Figure 1:
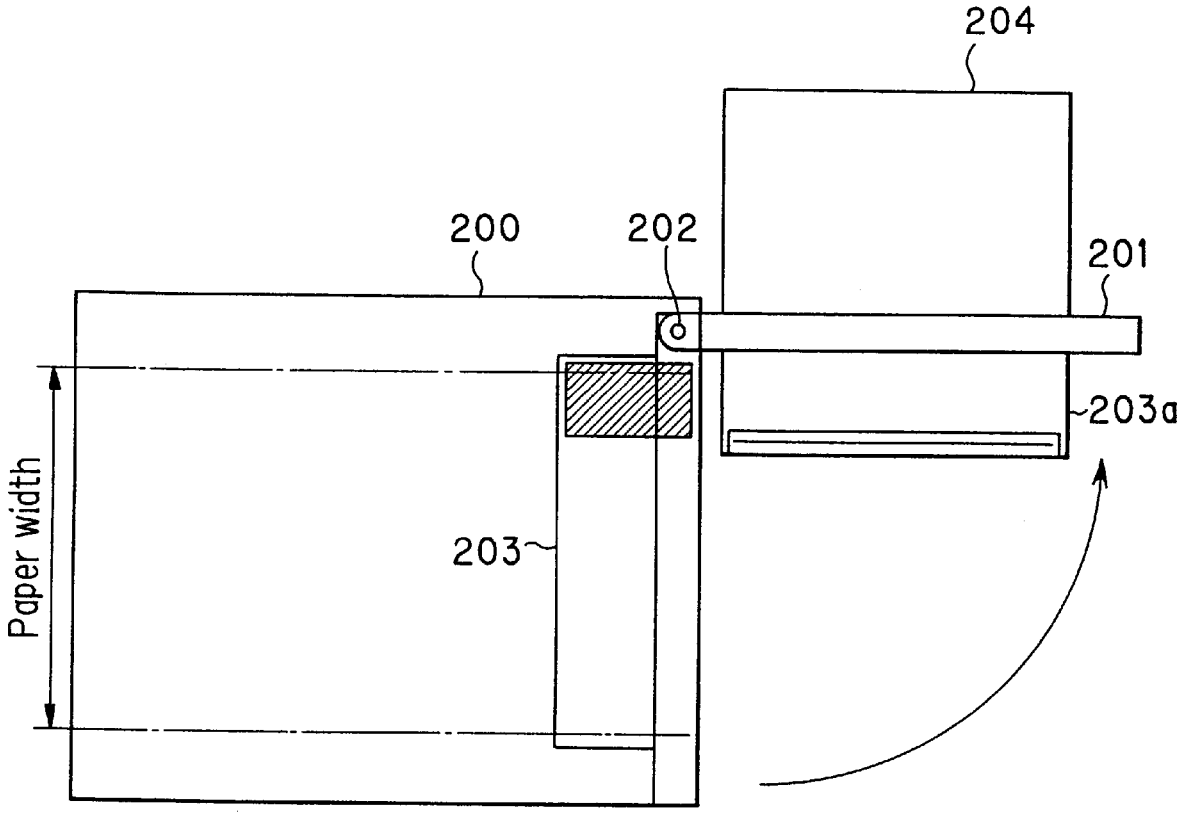
FIG. 1 PRIOR ART
FIG. 1 is a diagram illustrating the configuration of a paper transport path in a conventional sheet processing apparatus.
Figure 2:
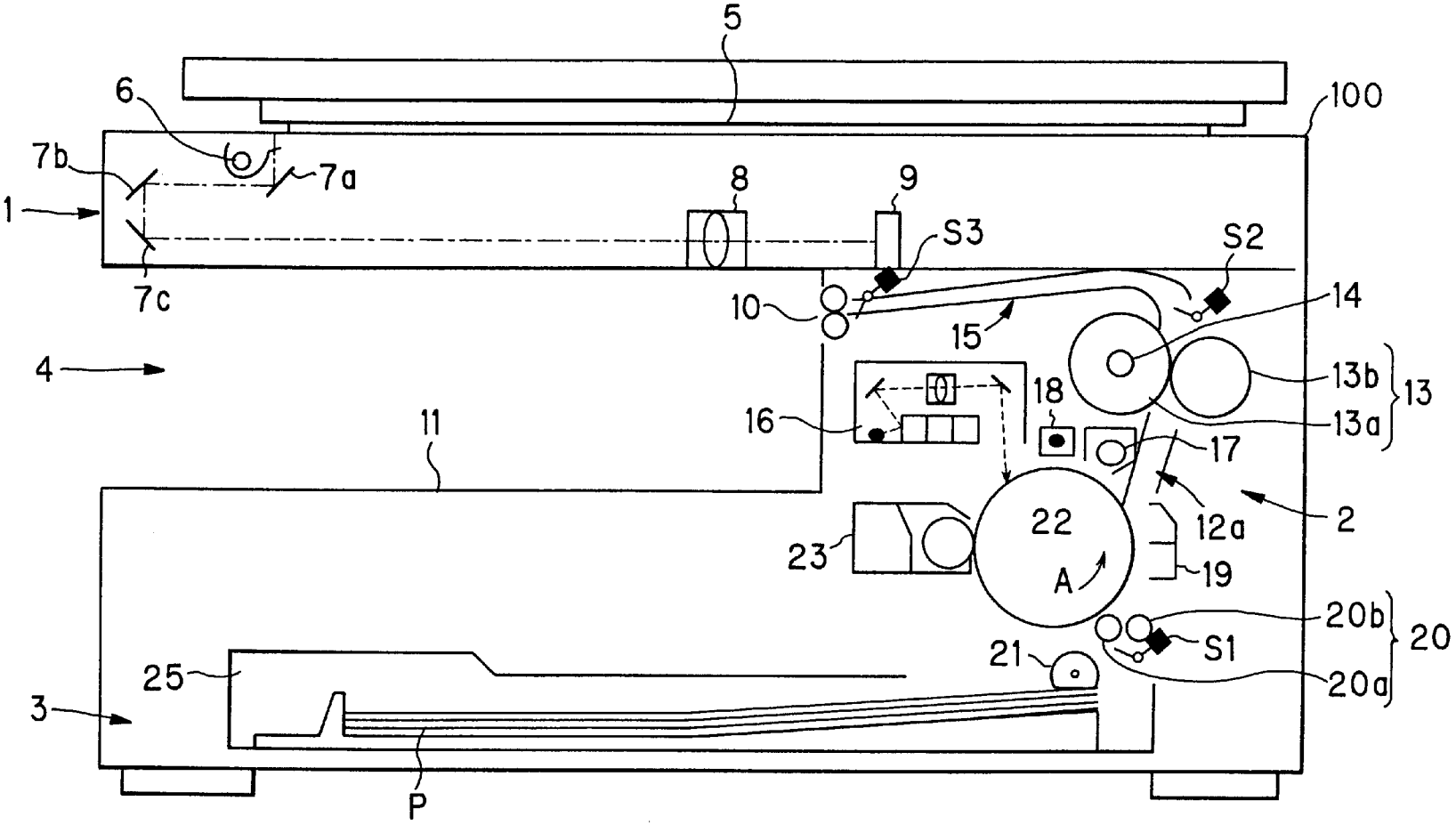
FIG. 2 is a schematic front sectional view showing the configuration of an image forming apparatus in accordance with an embodiment of the present invention.

An example of a sheet processing apparatus according to the embodiment of the present invention will be explained referring to an image forming apparatus. FIG. 2 is a schematic, front sectional view showing the configuration of an image forming apparatus in accordance with the embodiment of the present invention. An image forming apparatus 100 according to the embodiment of the present invention forms an image of an original on the surface of a sheet of paper by electrophotography. Therefore, image forming apparatus 100 comprises an optical system unit 1 on the top part thereof, an image forming unit 2 and a paper output portion 4 in the middle part and a paper feed portion 3 at the bottom.

Optical system unit 1 includes an original table 5 of transparent glass arranged on the top face of image forming apparatus 100, an exposure lamp 6, mirrors 7*a* to 7*c*, lens 8 and a photoelectric transducer (to be referred to as CCD hereinbelow) 9 underneath the original table, so as to read the image of an original placed on the top face of original table 5. Illustratively, exposure lamp 6 reciprocatingly moves together with mirrors 7*a* to 7*c*, in parallel with original table 5 to thereby expose the image of the original on original table 5 to light whilst thus reciprocating. Light from exposure lamp 6 is reflected by the original surface and is focused on CCD 9 after passing through mirrors 7*a* to 7*c* and lens 8. CCD 9 receives the reflected light from the original surface and outputs received light signals in accordance with the amount of received light.

Image forming unit 2 has a photoreceptor drum 22 having a photoconductive layer on the surface thereof and rotating in the direction of arrow A and further includes a primary charger 18, a laser writing unit 16, a developing unit 23, a transfer charger 19 and a cleaning unit 17 arranged around photoreceptor drum 22 in this sequential order in the rotational direction of photoreceptor drum 22, and forms an image on the surface of paper P fed from paper feed portion 3 using electrophotography. More specifically, in the charging step, primary charger 18 uniformly electrifies the surface of photoreceptor drum 22 with charge of one polarity. In the light exposure step, laser writing unit 16 illuminates the surface of photoreceptor drum 22 with a laser beam in accordance with the received light signals output from CCD 9 of optical system unit 1. In the developing step, developing unit 23 supplies the surface of photoreceptor drum 22 with toner having charge of the polarity opposite to that given from primary charger 18. In the transfer step, transfer charger 19 effects corona discharge from the underside of paper P. Cleaning unit 17 removes residual toner from the surface of photoreceptor drum 22.

Paper feed portion 3 has a detachable paper feed cassette 25 holding a number of sheets of paper P of the same size and a feed roller 21 axially supported at a position opposing the top surface of paper P stored in paper feed cassette 25, so as to feed paper P sheet by sheet to image forming unit 2. That is, as feed roller 21 rotates, the paper is delivered out sheet by sheet from paper feed cassette 25 to image forming unit 2.

Paper output portion 4 has discharge rollers 10, a paper output tray 11 and a discharge transport path 15 and discharges paper P, having the image of an original formed on the surface thereof through image forming unit 2, by the rotation of discharge rollers 10 along discharge transport path 15 onto paper output tray 11.

Arranged in image forming apparatus 100 is a primary transport path 12*a* from paper feed portion 3 to paper output portion 4 via image forming unit 2. This primary transport path 12*a*, together with an auxiliary transport path 12*b*, constitutes the paper transport path. More detailedly, primary transport path 12*a*, originates from the position where feed roller 21 is axially supported in paper feed portion 3, passing between photoreceptor drum 22 and transfer charger 19 in image forming unit 2 to reach discharge rollers 10 of paper output portion 4. Along this primary transport path 12*a*, registration rollers 20 (20*a*, 20*b*) are laid out between feed roller 21 and image forming unit 2 while fixing rollers 13 (13*a*, 13*b*) are arranged between image forming unit 2 and discharge rollers 10.

In this configuration, during image forming in image forming apparatus 100, the image of an original placed on original table 5 is read by optical system unit 1 so that the received light signal of the light reflected by the image surface of the original is output from CCD 9. The received light signal of CCD 9 is input to laser writing unit 16 of image forming unit 2 so that a laser beam from laser writing unit 16, modulated based on the image of the original, illuminates the surface of photoreceptor drum 22, which has been uniformly charged with charge of one polarity by primary charger 18, in synchronism with the rotation of photoreceptor drum 22, whereby a static latent image is formed on the surface of photoreceptor drum 22, by the photoconductive effect. This static latent image is developed by the toner supplied from developing unit 23, forming a toner image.

On the other hand, previous to the rotation of photoreceptor drum 22, a sheet of paper P is fed from paper feed portion 3. Paper P thus fed stops with its leading edge abutting against registration rollers 20. Registration rollers 20 start rotating in time with the rotation of photoreceptor drum 22 so that paper P will be led to the gap between photoreceptor drum 22 and transfer charger 19 at a timing which makes the leading position of the toner image formed on the surface of photoreceptor drum 22 correspond to the leading edge of the paper. Thereafter, the toner image supported on the surface of photoreceptor drum 22 transfers to the surface of paper P by corona discharge from transfer charger 19. The surface of photoreceptor drum 22 having passed by the position opposing transfer charger 19 is removed of residual toner by cleaning unit 17 and then followed by another operation of charging, exposure, development and transfer.

Paper P having a toner image transferred on the surface thereof is led to the nip of fixing rollers 13 along primary transport path 12*a* by an unillustrated conveying means. Fixing rollers 13 include a heat roller 13*a* having a heater lamp 14 therein and a pressing roller 13*b* abutting heat roller 13*a* with a predetermined nip pressure. Paper P is heated and pressed during passage of fixing rollers 13 so that the toner image is fused and fixed onto the surface of paper P. Paper P having passed through fixing rollers 13 is discharged to output tray 11 through discharge rollers 10.

Sensors S1 to S3 are arranged along primary transport path 12*a* to detect the paper near registration rollers 20, fixing rollers 13 and discharge rollers 10. If any one of sensors S1 to S3 continuously detects paper P longer than a predetermined time based on size in the conveyed direction and the conveyed speed of paper P, it is judged that a jam of paper P has occurred.

Viewed from the front, image forming apparatus 100 has a shape approximating a mirrored C, formed by optical system unit 1, image forming unit 2 and the paper feed portion 3. That is, the widths of optical system unit 1 and paper feed portion 3 are greater than the width of image forming portion 2. This setting enables optical system unit 1 to read the image of the original having a size greater than the maximum size of feedable paper from paper feed portion 3. In this case, the planer dimensions of optical system unit 1, which requires the maximum space, are set to be the maximum planer dimensions, i.e., the footprint of image forming apparatus 100, while image forming unit 2 having a shorter width than optical system unit 1 is arranged to the right side under optical system unit 1 and paper feed portion 3 is arranged under image forming unit 2. In this configuration, paper output tray 11 is arranged in the space formed on the left side of image forming unit 2 and between optical system unit 1 and paper feed portion 3.

For example, suppose the maximum original size which can be read by optical system unit 1 is B4 size (364 mm×257 mm) and the maximum copy size of paper which can be fed from paper feed portion 3 is A4 size (297 mm×210 mm), the width of optical system unit 1 will be about 490 mm. This is because it is necessary to provide layout space for exposure lamp 6 and mirrors 7*a* to 7*c* and their driving portion, in addition to the length of B4 size paper (364 mm). Compared to this, the width of image forming portion 2 is about 240 mm, and when image forming unit 2 is arranged to the right side under optical system unit 1, a space as much as about 250 mm is formed on the left side of image forming unit 2, which is large enough to accommodate discharged A4 size paper P of 297 mm long.

Figure 3:
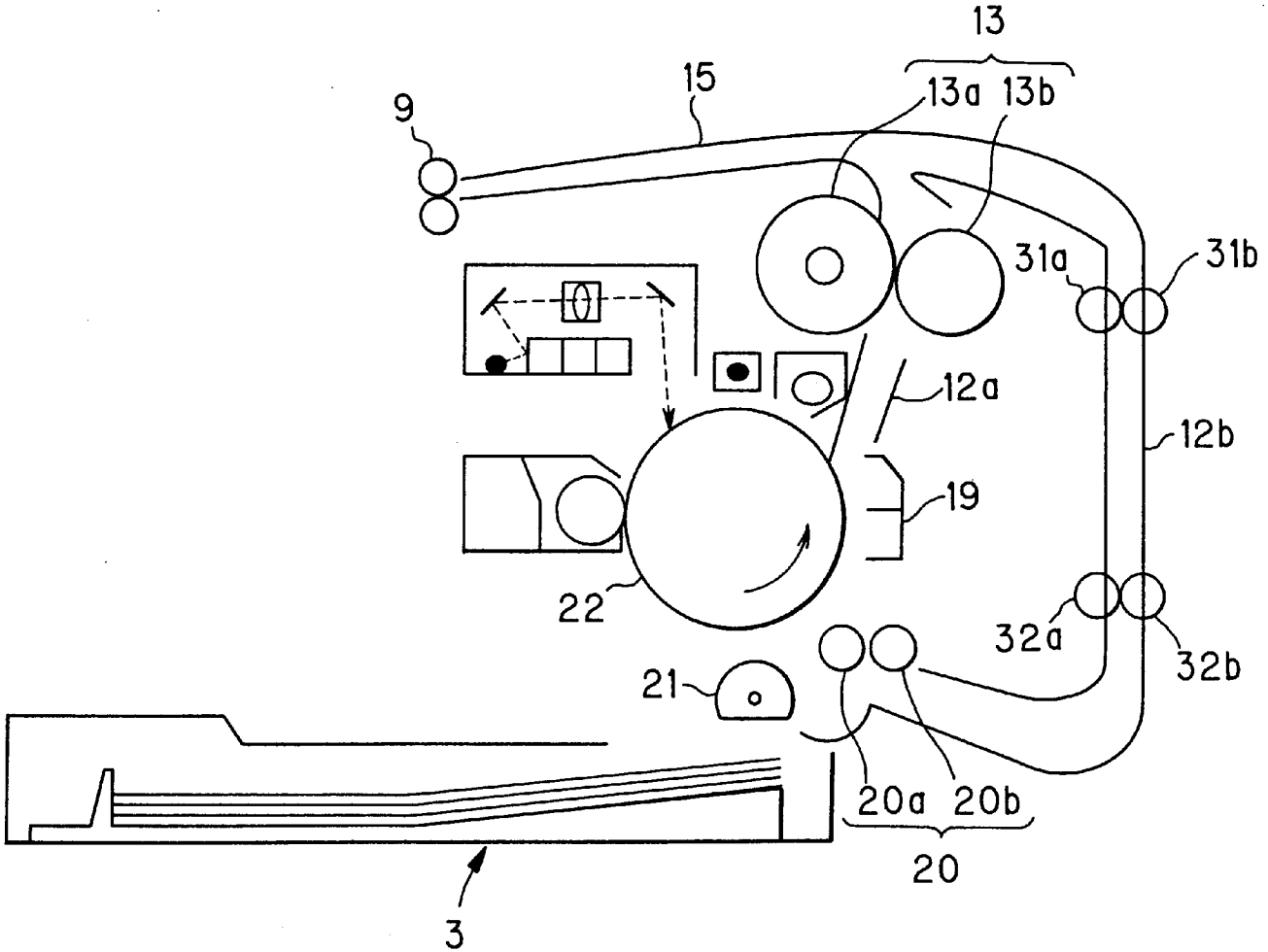
FIG. 3 is a diagram illustrating the configuration of the paper transport path in the image forming apparatus.

FIG. 3 is a view illustrating the configuration of the paper transport path in the image forming apparatus. As stated above, primary transport path 12*a* is arranged approximately vertically between photoreceptor drum 22 and transfer charger 19 and between fixing rollers 13, on the right side of image forming unit 2 inside image forming apparatus 100. Discharge transport path 15 as a part of paper output portion 4 is formed continuous to the upper end of primary transport path 12*a* in the upper portion of image forming unit 2. Formed on the right side of primary transport path 12*a* is auxiliary transport path 12*b* in an approximately vertical manner. This auxiliary transport path 12*b* is formed extending from discharge transport path 15 to paper feed portion 3. More detailedly, auxiliary transport path 12*b* forms a shape approximating a mirrored C, extending from the joined portion between primary transport path 12*a* and discharge transport path 15 to the position prior to registration rollers 20.

In the above image forming apparatus 100, when images are formed on both sides of paper P, the paper having an image formed on one side thereof is conveyed into discharge transport path 15 where part of paper P is nipped by discharge rollers 9, then paper P is conveyed into auxiliary path 12*b* by the reverse rotation of discharge rollers 9. By this configuration, paper P having an image on one side thereof is conveyed to paper feed portion 3 with its front end to the rear with respect to the conveyed direction. Thereafter, as registration roller 20 starts rotating, paper P is led to the gap between photoreceptor drum 22 and transfer charger 19 with its undersurface opposing to the surface of photoreceptor drum 22 thus forming an image on the underside of paper P.

In image forming apparatus 100, primary transport path 12*a* is configured by components opposing both the observe surface and undersurface of paper P. Of the components constituting primary transport path 12*a*, those opposing the right-hand side surface of paper P include registration roller 20*b* on one side, transfer charger 19 and pressing roller 13*b*. Of the components constituting primary transport path 12*a*, those opposing the left-hand side surface of paper P include the remaining registration roller 20*a*, photoreceptor drum 22 and heat roller 13*a*.

Arranged along auxiliary transport path 12*b* in image forming apparatus 100 are conveyance rollers 31 (31*a* and 31*b*) and conveyance rollers 32 (32*a* and 32*b*). Thus, auxiliary transport path 12*b* is also configured of the components which oppose both sides of paper P. Of the components constituting auxiliary transport path 12*b*, those opposing the right-hand side surface of paper P include conveyance rollers 31*b* and 32*b* on one side. Of the components constituting auxiliary transport path 12*a*, those opposing the left-hand side surface of paper P include the remaining conveyance rollers 31*a* and 32*a*.

Figure 4:
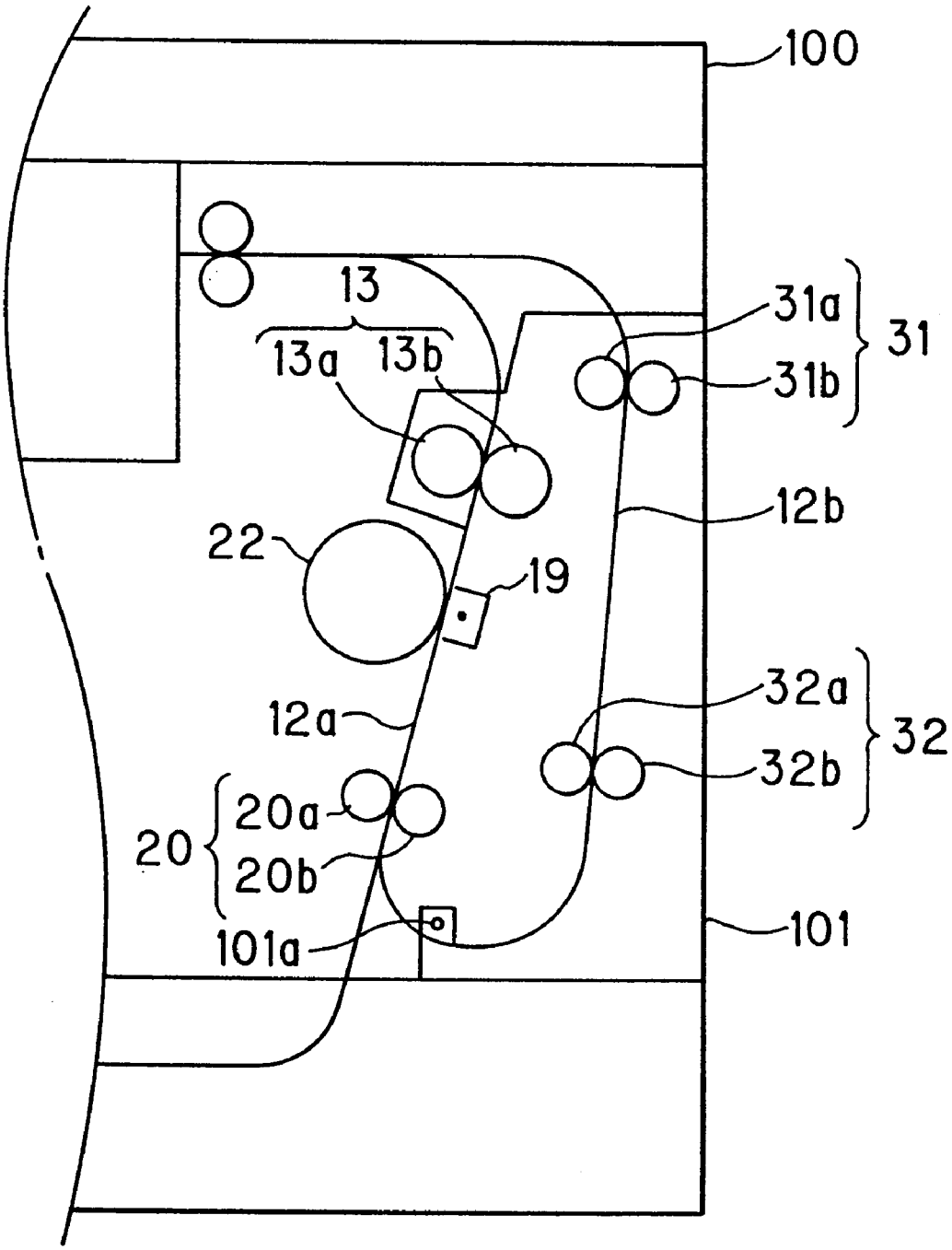
FIG. 4 is a diagram illustrating the detail of the paper transport path in the image forming apparatus.
Figure 5A:
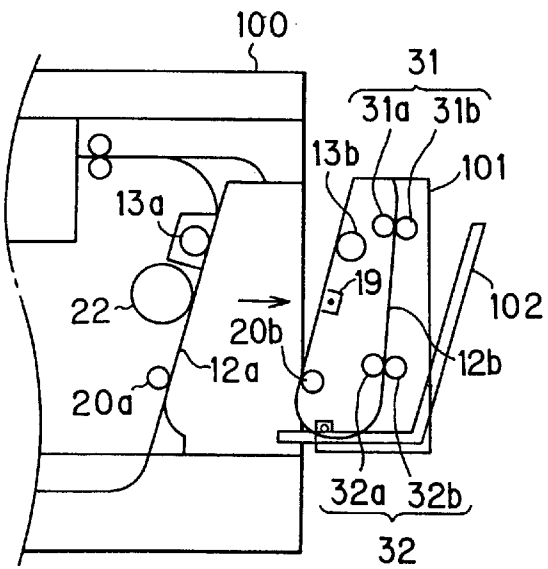
FIGS. 5A to 5C are diagrams illustrating the opened state of the paper transport path in the image forming apparatus.
Figure 5B:
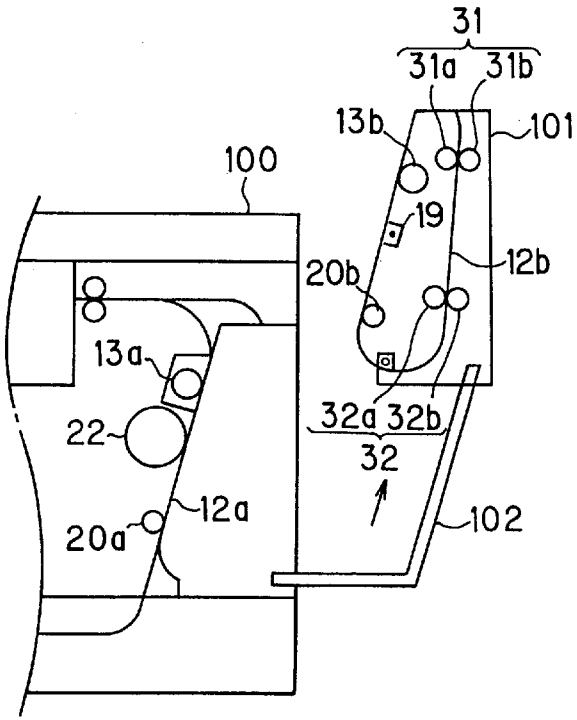
Figure 5C:
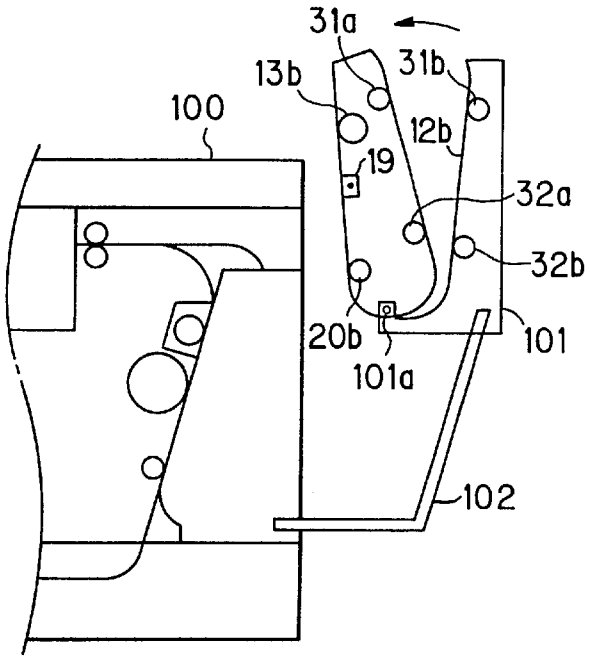

FIG. 4 is a view illustrating in detail the paper transport path in the above image forming apparatus. FIGS. 5A to 5C are views illustrating the opened states of the paper transport path in the above image forming apparatus. Of the components constituting primary transport path 12*a*, components (including registration roller 20*b* on one side, transfer charger 19 and pressing roller 13*b*) opposing the right-hand side surface of paper P and the components constituting auxiliary path 12*b* are supported on a side panel cover 101 on the right side of image forming apparatus 100. This side panel cover 101 can be pulled out horizontally to the right from image forming apparatus 100 and further can be moved in the upper right direction. In side panel cover 101, the components (including registration roller 20*b* on one side, transfer charger 19 and pressing roller 13*b*) opposing the right-hand side surface of paper P, being among the components constituting primary transport path 12*a*, and the components (including the remaining conveyance rollers 31*a* and 32*a*) opposing the left-hand side surface of paper P, being among the components constituting auxiliary transport path 12*b*, are integrally axially supported by an axle 101*a* located in the lower portion.

As shown in FIG. 5A, when side panel cover 101 is pulled out along a guide member 102 horizontally from the image forming apparatus body to the right, the components (including registration roller 20*b* on one side, transfer charger 19 and pressing roller 13*b*) opposing the right-hand side surface of paper P, being among the components constituting primary transport path 12*a*, move horizontally to the right together with side panel cover 101, away from the components (including the remaining registration roller 20*a*, photoreceptor drum 22 and heat roller 13*a*) opposing the left-hand side surface of paper P, being among the components constituting primary transport path 12*a*. In this way, primary transport path 12*a* is made open across substantially its entire surface to a predetermined distance.

As shown in FIG. 5B, when side panel cover 101 is pulled out horizontally to the right from image forming apparatus, 100 and then is moved in the upper right direction along guide member 102, the components (including registration roller 20*b* on one side, transfer charger 19 and pressing roller 13*b*) opposing the right-hand side surface of paper P, being among the components constituting primary transport path 12*a*, moves in the upper right direction together with side panel cover 101, so as to be placed at a position set-off from a position where they oppose the components (including the remaining registration roller 20*a*, photoreceptor drum 22 and heat roller 13*a*) opposing the left-hand side surface of paper P, being among the components constituting primary transport path 12*a*. Thus, primary transport path 12*a* is made completely open in such a manner that the two assemblies constituting primary transport path 12*a* are set away from the position where the two assemblies oppose each other.

Here, side panel cover 101 and guide member 102 have engaging means with which they engage each other. One of the engaging means has an operating member linked therewith and an elastic member which urges the one engaging means toward the other engaging means. The engagement between the two engaging means enables the state shown in FIG. 5B to be maintained. In this case, it is possible to recover the state shown in FIG. 5A from the state shown in FIG. 5B by disengaging the engagement between the two engaging means by moving the operating member in opposition to the elastic force of the elastic member.

As shown in FIG. 5C, in the state where side panel cover 101 has been moved in the upper right direction after being pulled out horizontally to the right from the image forming apparatus body, when the components (including registration roller 20*b* on one side, transfer charger 19 and pressing roller 13*b*) opposing the right-hand side surface of paper P, being among the components constituting primary transport path 12*a*, and the components (including the remaining conveyance rollers 31*a* and 32*a*) opposing the left-hand side surface of paper P, being among the components constituting auxiliary transport path 12*b* are integrally rotated counterclockwise about an axle 101*a* located in the lower portion, the components (including the remaining conveyance rollers 31*a* and 32*a*) opposing the left-hand side surface of paper P, being among the components constituting auxiliary transport path 12*b* are made to move away from the components (including the conveyance rollers 31*b* and 32*b* on one side) opposing the right-hand side surface of paper P, being among the components constituting auxiliary transport path 12*b*, thereby opening auxiliary transport path 12*b*.

In side panel cover 101, the components opposing the right-hand side surface of paper P, being among the components constituting primary transport path 12*a* and the components opposing the left-hand side surface of paper P, being among the components constituting auxiliary transport path 12*b* and the components opposing the right-hand side surface of paper P, being among the components constituting auxiliary transport path 12*b*, all have engaging means for engaging one another. Further, one of the engaging means has an operating member linked therewith and an elastic member which urges one engaging means toward the other engaging means, so that this engaging between the two engagement means enables the state shown in FIG. 5C to be maintained. In this case, it is possible to recover the state shown in FIG. 5B from the state shown in FIG. 5C by disengaging the engagement between the two engaging means by moving the operating member in opposition to the elastic force of the elastic member.

Thus, in image forming apparatus 100 according to the embodiment of this invention, it is possible to open primary transport path 12*a* to a predetermined distance across substantially its entire surface by drawing out the side panel cover 101 in the horizontal direction to the right from the apparatus body. Further, after side panel cover 101 has been pulled out horizontally from the apparatus body to the right and then moved in the upper right direction, it is possible to completely open primary transport path 12*a* across substantially its entire surface, by moving side panel cover 101 horizontally and vertically relative to the apparatus body, in a manner so that the components on one side constituting primary transport path 12*a* do not opposes the components on the other side. Moreover, in the state where side panel cover 101 has been moved horizontally and vertical relative to the apparatus body, the rotation of the right side components constituting primary transport path 12*a* integrally with the left side components constituting auxiliary transport path 12*b* makes it possible to open auxiliary transport path 12*b*.

Consequently, if paper P has jammed in primary transport path 12*a* or auxiliary transport path 12*b*, it is possible to easily remove paper P by opening primary transport path 12*a* or auxiliary transport path 12*b*. Particularly, primary transport path 12*a* can open to a predetermined distance across substantially its entire surface by drawing out side panel cover 101 horizontally from the apparatus body to the right. Further, by moving side panel cover 101 horizontally and vertically relative to the apparatus body, primary transport path 12*a* can be completely opened across substantially the entire surface. Accordingly, paper P jamming in primary transport path 12*a* can be markedly easily and reliably removed.

Since side panel cover 101 is pulled out horizontally with respect to the apparatus body, there is no need to provide a large space on the rear side of the apparatus even with the manual feed tray attached to side panel cover 101, which would be needed in the configuration where side panel cover 101 is rotated relative to the apparatus body. Further, there occurs no insufficiency in the opening space of the paper transport path due to restriction of the rotational range of side panel cover 101 by the abutment between the manual feed tray and the floor.

Besides, since heat roller 13*a* and pressing roller 13*b* constituting fixing rollers 13 in primary transport path 12*a* can be separated, it is possible to prevent the operator from touching high-temperature heat roller 13*a* with their fingers during jam cancellation. This reference will not limit the configuration of fixing rollers 13 to the combination of heat roller 13*a* and pressing roller 13*b*.

The components opposing the right side of paper P, being among the components constituting primary transport path 12*a*, may be configured so that they will only move horizontally together with side panel cover 101. In this case, however, primary transport path 12*a* can be opened only to a predetermined distance across its entire surface, but cannot be exposed substantially or completely across the entire surface (in such a manner that the components constituting one side of primary transport path 12*a* and the components constituting the other side will not oppose each other).

In order to secure a large enough opening distance for primary transport path 12*a*, it is necessary to provide a large distance for movement in the horizontal direction. In this respect, when the components opposing the right-hand side surface of paper P, being among the components constituting primary transport path 12*a* are configured to be moved horizontally and vertically together with side panel cover 101, it is possible to further reduce the space for installation of image forming apparatus 100 since primary transport path 12*a* can be substantially or completely opened across its entire surface even with a smaller distance for movement in the horizontal direction.

Figure 6A:
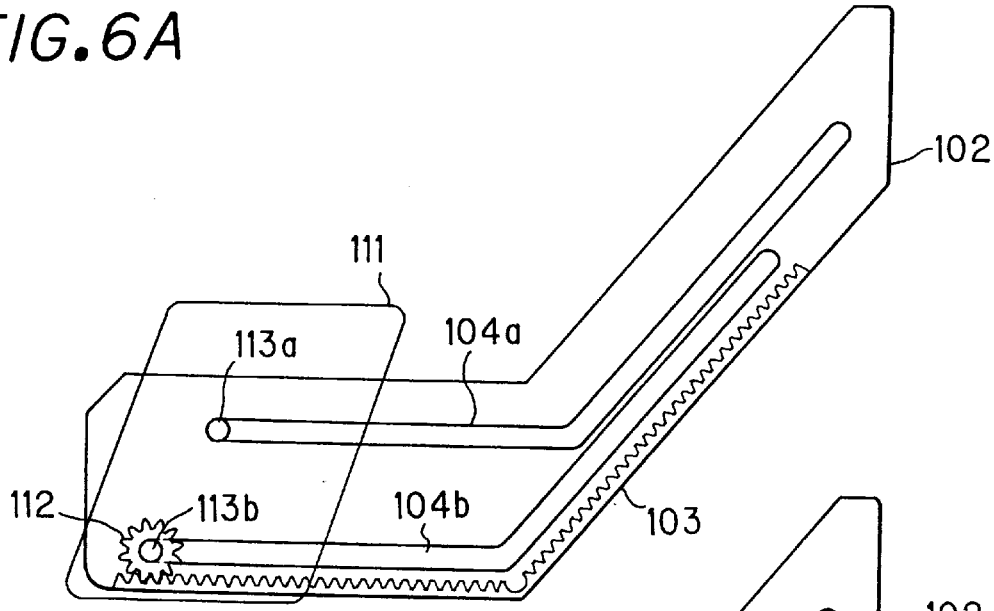
FIGS. 6A to 6C are diagrams illustrating a configuration for moving a side panel cover in horizontal and vertical directions in the image forming apparatus.
Figure 6B:
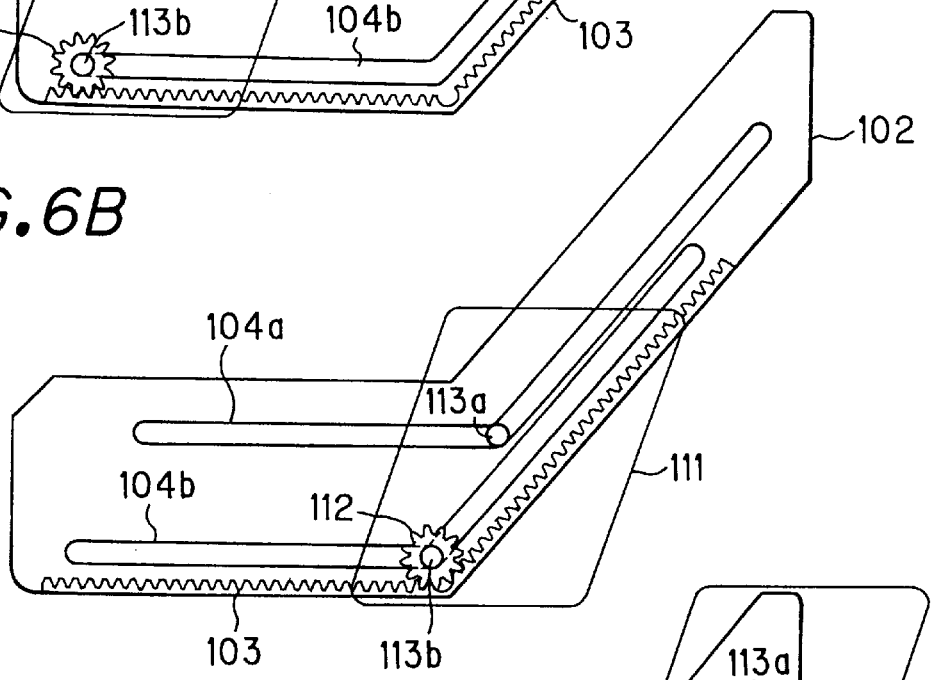
Figure 6C:
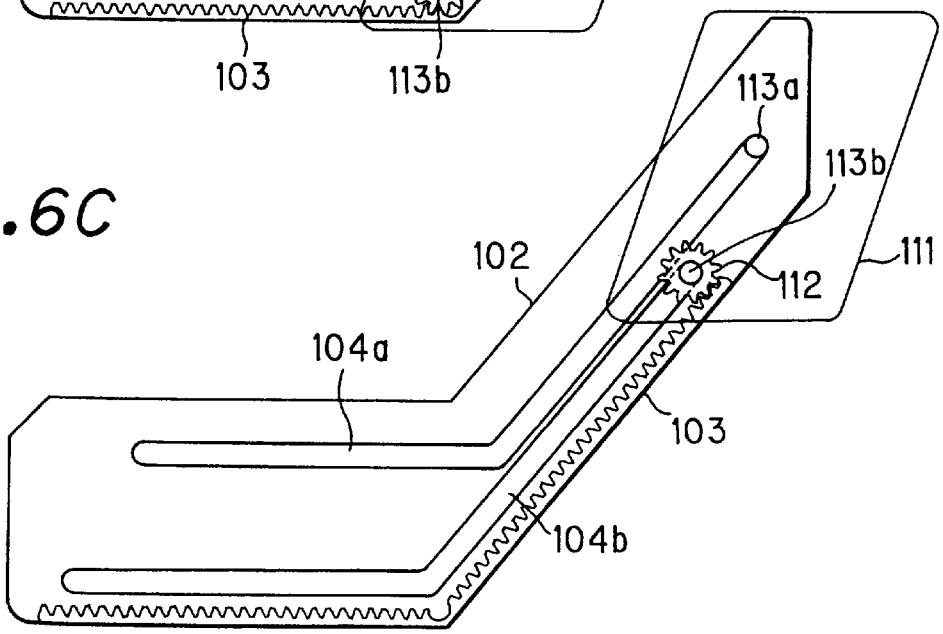

FIGS. 6A to 6C are views showing the mechanism for moving the side panel cover horizontally and vertically in the above image forming apparatus. Arranged on the right-hand side of image forming apparatus 100 is a guide means 102 having a shape approximating an open-V, which can be horizontally drawn separately away from side panel cover 101. This guide means 102 has a rack 103 and two slots 104*a* and 104*b*, all being of a horizontal part and a part extending in the upper right direction contiguous with the horizontal part. A supporting part 111 of side panel cover 101 axially supports a pinion 112 which meshes with rack 103 and has pins 113*a* and 113*b* fitted to slots 104*a* and 104*b* formed on guide means 102.

When side panel cover 101 is moved horizontally and vertically with respect to the apparatus body of image forming apparatus 100, guide means 102 is, at first, pulled out from the right side of apparatus body. In this case, as shown in FIG. 6A, pinion 112 axially supported on supporting part 111 meshes with the left end or thereabout of the horizontal part of rack 103 formed in guide means 102 while pins 113*a* and 113*b* formed on supporting part 111 are fitted in the left end or thereabout of the horizontal part of slots 104*a* and 104*b* formed in guide means 102.

In the state shown in FIG. 6A, when a rightward external force is applied to side panel cover 101, pins 113*a* and 113*b* formed on supporting part 111 slide along the horizontal parts of slots 104*a* and 104*b* of guide means 102 while pinion 112 axially supported on supporting part 111 rotates clockwise and meshes with the horizontal part of rack 103 moving rightward. In this way, supporting part 111 moves horizontally together with side panel cover 101 to the position shown in FIG. 6B.

In the state shown in FIG. 6B, when an external force rightward and upward is acted on side panel cover 101, pins 113*a* and 113*b* formed on supporting part 111 slide along the inclined parts of slots 104*a* and 104*b* of guide means 102 while pinion 112 axially supported on supporting part 111 rotates clockwise and meshes with the inclined part of rack 103 moving in the upper right direction. In this way, supporting part 111 moves in the upper right direction together with side panel cover 101 up to the position shown in FIG. 6C.

Here, when guide means 102 is retracted within the apparatus body of image forming apparatus 100, supporting part 111 may be placed at a position shown in FIG. 6A or FIG. 6B with respect to guide means 102.

Here, guide means 102 can be provided with one on both or either of front and rear sides being on the right-hand side of the apparatus body of image forming apparatus 100. When guide means 102 of a single structure is used, it should be disposed on the rear side of the apparatus body in view of its working performance during jam cancellation.

Further, guide means 102 should not be limited to the shape shown in FIGS. 6A to 6C. For example, when guide means 102 is configured to be pulled out horizontally together with supporting part 111 from the right side face of the apparatus body, it is possible to do away with the horizontal parts of rack 103 and slots 104*a* and 104*b* shown in FIGS. 6A to 6C.

In addition, it is also possible to configure side panel cover 101 in such a manner that the components opposing the right-hand side surface of paper P, being among the components constituting primary transport path 12*a* and the components opposing the left-hand side surface of paper P, being among the components constituting auxiliary transport path 12*b* can move horizontally to the left and vertically with respect to the components opposing the right-hand side surface of paper P, being among the components constituting auxiliary transport path 12*b*. In this case, a pair of supporting parts 111 and guide means 102 shown in FIGS. 6A to 6C may be arranged in a line symmetry on both the left and right sides, that is, one for the components opposing the right-hand side surface of paper P, being among the components constituting primary transport path 12*a* and the components opposing the left-hand side surface of paper P, being among the components constituting auxiliary transport path 12*b*; and the other for the components opposing the right-hand side surface of paper P, being among the components constituting auxiliary transport path 12*b*. With this configuration, it is possible to open auxiliary transport path 12*b* to a uniform distance across substantially its entire surface of auxiliary transport path 12*b*, as well as open it substantially completely across its surface (the components constituting one side of auxiliary transport path 12*b* and the other components will not oppose each other).

Further, it is also possible to have a configuration such that guide means 102 is affixed inside the apparatus body in conformity with the position and size of side panel cover 101 relative to the apparatus body of image forming apparatus 100, while side panel cover 101 integrated with only the components on one side of primary transport path 12*a* and the components of auxiliary transport path 12*b* can be moved horizontally and vertical along guide means 102.

Figure 7:
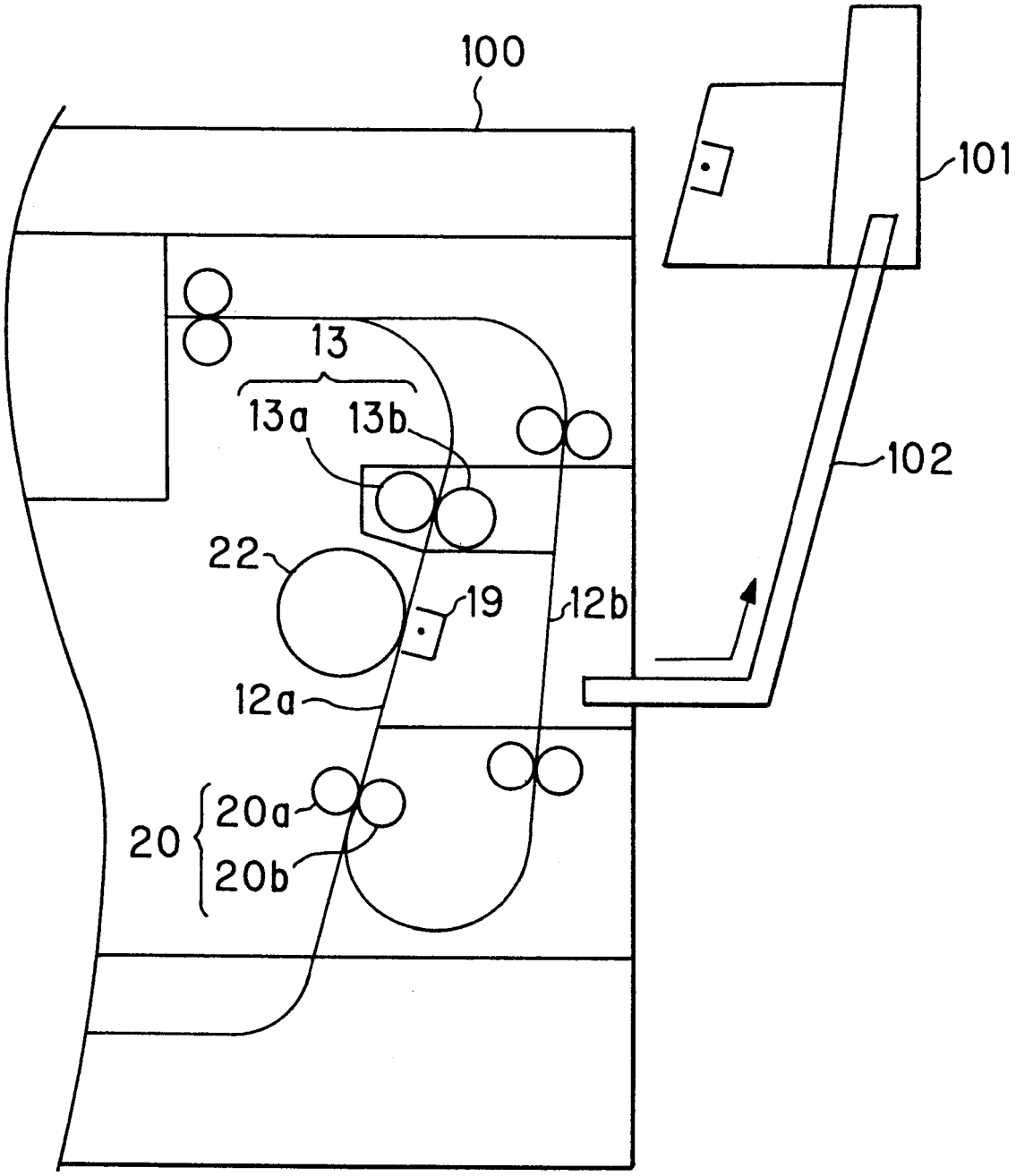
FIG. 7 is a diagram showing essential parts of an image forming apparatus in accordance with another embodiment of the present invention; and, FIG. 8 is a view showing the relationship between the side panel cover and the manual feeder tray in the image forming apparatus in accordance with an embodiment of the present invention.

FIG. 7 is a view showing the configuration of essential parts of an image forming apparatus in accordance with another embodiment of the present invention. The image forming apparatus in accordance with the embodiment is configured such that the area which only includes photoreceptor drum 22 and transfer charger 19 of primary transport path 12*a* and auxiliary transport path 12*b* can be moved horizontally and vertically, together with side panel cover 101. In this way, a configuration where only part of primary transport path 12*a* and auxiliary transport path 12*b* can be moved horizontally and vertically together with side panel cover 101, can reduce the horizontal distance of movement and the space for installation of image forming apparatus 100.

Here, this partial area, capable of being moved horizontally and vertically, of primary transport path 12*a* and auxiliary transport path 12*b* should not be limited to the above-mentioned area only including photoreceptor drum 22 and transfer charger 19. For example, an area only including fixing rollers 13, or an area only including registration rollers 20 may be configured to be able to move horizontally and vertically together with side panel cover 101, taking into account the jam frequencies etc.

Alternatively, primary transport path 12*a* and auxiliary transport path 12*b* may be divided into multiple parts so that each part can individually be moved horizontally and vertically. This configuration can reduce the space for installation of image forming apparatus 100 whilst allowing the operator to partly open the position where paper jam occurs and correctly implement jam cancellation when paper P has jammed at any portion in primary transport path 12*a* and auxiliary transport path 12*b*. In this case, a multiple number of sensors for detecting occurrence of paper P jamming may be provided at appropriate sites in primary transport path 12*a* and auxiliary transport path 12*b* so as to inform the operator of where a jam is occurring based on the detection signal from the sensors.

Figure 8:
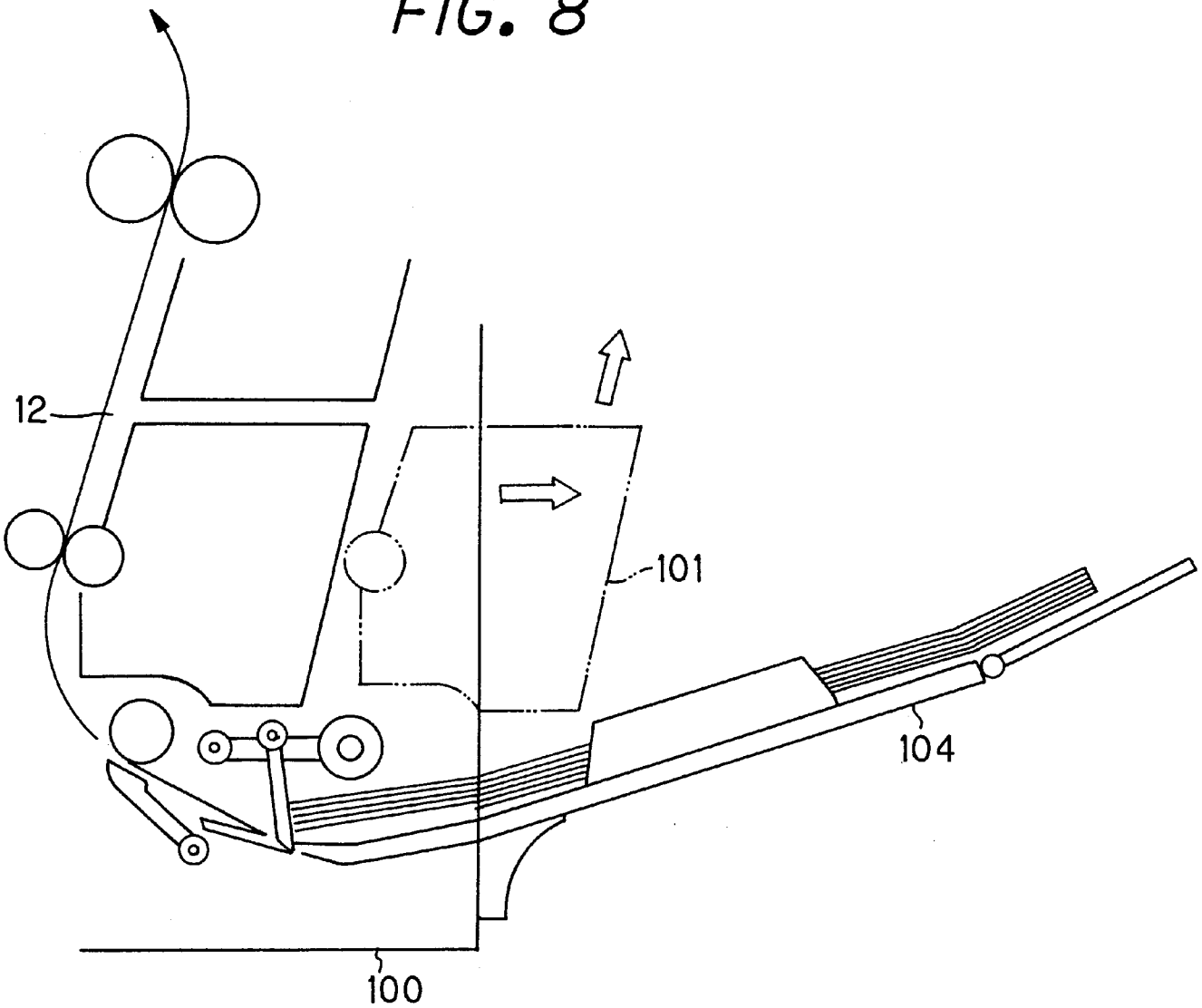

In a case where the manual feeder tray is attached on the right side face of the apparatus body of image forming apparatus 100, it is possible to have a configuration such that the manual feeder tray can move together with side panel cover 101 which moves horizontally and vertically relative to the apparatus body. Alternatively, when taking into account the typical configuration in which manual feed of paper is effected near the lowermost position of paper transport path 12 as shown in FIG. 8, side panel cover 101 moving relative to the apparatus body can be arranged above the position of attachment of manual feeder tray 104 on the right side of image forming apparatus 100 so that manual feeder tray 104 will stay stationary when side panel cover 101 is moved horizontally and vertically relative to the apparatus body. In this case, the assembly to be moved relative to the apparatus body during jam cancellation can be downsized, thus making it possible to reduce the space for installation of image forming apparatus 100.

As the embodiments of the present invention have been described heretofore with the example of an image forming apparatus, the present invention can be applied in a similar manner to other apparatus, such as an image scanner or a folding machine, having a transport path for conveying sheets from the paper feeder to the paper output portion by way of a processing portion.

In accordance with the first feature of the invention, among the components arranged on both sides of the paper from the paper feed portion to the paper output portion by way of the processing portion, the components opposing one side of the paper is adapted to move horizontally together with the side panel cover with respect to the apparatus body. Thereby, the side panel cover is moved horizontally relative to the apparatus body so that the components constituting one side of the paper transport path can be separated horizontally from the components on the other side, thus making it possible to open the paper transport path across substantially its entire surface to a predetermined distance. This configuration facilitates easy jam cancellation without the necessity of providing a large space for installation of the apparatus.

In accordance with the second feature, either the components on one side, being among the components constituting the primary transport path, arranged on both sides of the paper from the paper feed portion to the paper output portion by way of the processing portion, or the components on one side, being among the components constituting the auxiliary transport path, arranged on both sides of the paper from the paper output portion to the paper feed portion, are adapted to move horizontally together with the side panel cover with respect to the apparatus body. Thereby, the side panel cover is moved horizontally relative to the apparatus body so that the components constituting one side of the primary transport path or auxiliary transport path can be separated in the horizontal direction from the components on the other side, thus making it possible to open the primary transport path or the auxiliary transport path, across its substantially entire surface to a predetermined distance. This configuration faculties easy jam cancellation without the necessity of providing a large space for installation of the apparatus.

In accordance with the third and fourth features of the invention, the components constituting one side of the paper transport path are integrated with the side cover panel and are configured to be movable in the horizontal direction and vertical direction relative to the apparatus body. Thereby, the movement of the side panel cover in the horizontal and vertical directions relative to the apparatus body enables the components constituting one side of the paper transport path to be separated horizontally from the components on the other side and then to be separated vertically, thus making it possible to substantially or completely open the paper transport path in a manner so that the components on one side will not oppose the components on the other side. This configuration can further reduce the space for installation of the apparatus.

In accordance with the fifth and sixth features of the invention, the components constituting one side of the primary transport path and the components constituting the auxiliary transport path are adapted to move together with the side panel cover horizontally and vertically relative to the apparatus body while the components constituting one side of the primary transport path and the components constituting the other side of the auxiliary transport path are axially supported integrally at an axle located in the lower portion. Thereby, the movement of the side panel cover horizontally and vertically relative to the apparatus body, enables the components constituting one side of the primary transport path to be separated horizontally and vertically from the components on the other side, thus making it possible to substantially or completely open the primary transport path in a manner so that the components on one side will not oppose the components on the other side. Further, in the side panel cover, the components constituting one side of the primary transport path and the components constituting the other side of the auxiliary transport path are integrally rotated at the axle located in the lower end portion, so that it is possible to separate the components constituting the other side of the auxiliary transport path from the components on one side to thereby open the auxiliary transport path. This configuration facilitates easy jam cancellation in the primary transport path and the auxiliary transport path without the necessity of providing a large space for installation of the apparatus.

In accordance with the seventh through twelfth features of the invention, the paper feed portion and the paper output portion are arranged vertically with the processing portion in between in the apparatus body so as to configure a paper transport path extending approximately vertically from the paper feed portion to the paper output portion by way of one side of the processing portion. Thereby, it is possible to form the paper transport path near one side panel cover of the apparatus substantially parallel thereto as well as to optimally lay out the paper feed portion, processing portion, paper output portion and paper transport path in the apparatus body in order to allow one side of the components constituting the paper transport path to be moved together with the side panel cover with respect to the apparatus body.

In accordance with the thirteenth through eighteenth features of the invention, since the processing portion is an image forming portion for forming images on one side or both sides of the paper being conveyed from the paper feed portion to the paper output portion along the paper transport path, the paper jammed in the paper transport path before and after the one-side or duplex image forming process can be exposed to the outside, without the necessity of providing a large space for installation of the image forming apparatus.

In accordance with the nineteenth through twenty-fourth features of the invention, since in the apparatus body, the paper transport path from the paper feed portion to the paper output portion is formed by the gap between the photoreceptor drum and the transfer device and a pair of rollers constituting a fixing unit, and the transfer device and one of the rollers constituting the fixing unit are affixed on the side panel cover, the transfer device and one roller of the fixing unit are separated from the photoreceptor drum and the other roller of the fixing unit when the side panel cover is moved relative to the apparatus body so as to create open space between the photoreceptor drum and transfer device and between the pair of rollers of the fixing unit, along the paper transport path. Therefore, it is possible to easily cancel jams of the paper being conveyed during image forming without the necessity of providing a large space for installation of the image forming apparatus.

What is claimed is:

1. A sheet processing apparatus comprising:

a paper feed portion;

a processing portion;

a paper output portion;

a paper transport path defined from the paper feed portion to the paper output portion by way of the processing portion, by components arranged opposing both sides or surfaces of a paper sheet to be transported; and a side panel cover, which is integrated with the components opposing one of the paper sheet's surfaces on one side of an apparatus body, being among the components constituting the paper transport path, wherein the side panel cover is adapted to move horizontally with respect to the apparatus body;

wherein the paper transport path includes a primary transport path defined from the paper feed portion to the paper output portion by way of the processing portion, by components opposing both sides or surfaces of the paper sheet to be transported, and an auxiliary transport path defined from the paper output portion to the paper feed portion, by components opposing both sides or surfaces of the paper to be transported; and wherein the side panel cover is integrated with either the components opposing the paper sheet's sides or surfaces on one side of the apparatus body, being among the components constituting the primary transport path, or the components opposing the paper sheet's sides or surfaces on one side of the apparatus body, being among the components constituting the auxiliary transport path.

2. The sheet processing apparatus according to claim 1, wherein the side panel cover is movable in a horizontal direction and a vertical direction relative to the apparatus body.

3. The sheet processing apparatus according to claim 2, wherein the paper transport path includes a primary transport path defined from the paper feed portion to the paper output portion by way of the processing portion by components opposing both sides or surfaces of the paper sheet to be transported and an auxiliary transport path disposed closer to one side of the apparatus body with respect to the primary transport path and defined from the paper output portion to the paper feed portion, by components arranged opposing both sides or surfaces of the paper sheet to be transported; the components opposing the paper sheet's surface on one side of the apparatus body, being among the components constituting the primary transport path and the components constituting the auxiliary transport path are integrated with the side panel cover and are arranged movable horizontally and vertically relative to the apparatus body; and the components opposing the paper sheet's surface on one side of the apparatus body, being among the components constituting the primary transport path and the components opposing the paper sheet's surface on the other side of the apparatus body, being among the components constituting the auxiliary transport path are integrally axially supported at an axle located in a lower end portion.

4. The sheet processing apparatus according to claim 3, wherein the paper transport path is formed approximately vertically between the paper feed portion and the paper output portion, which are arranged vertically in the apparatus body with the processing portion in between, so as to be arranged by way of one side of the processing portion.

5. The sheet processing apparatus according to claim 4, wherein the processing portion is an image forming portion for forming images on one or both sides of the paper sheet.

6. The sheet processing apparatus according to claim 5, wherein the paper transport path is defined by a gap between a photoreceptor and a transfer device in an image forming portion and a pair of rollers constituting a fixing unit, and the transfer device and one of the rollers constituting the fixing unit are affixed on the side panel cover.

7. The sheet processing apparatus according to claim 2, wherein the paper transport path is formed approximately vertically between the paper feed portion and the paper output portion, which are arranged vertically in the apparatus body with the processing portion in between, so as to be arranged by way of one side of the processing portion.

8. The sheet processing apparatus according to claim 7, wherein the processing portion is an image forming portion for forming images on one or both sides of the paper sheet.

9. The sheet processing apparatus according to claim 8, wherein the paper transport path is defined by a gap between a photoreceptor and a transfer device in an image forming portion and a pair of rollers constituting a fixing unit, and the transfer device and one of the rollers constituting the fixing unit are affixed on the side panel cover.

10. The sheet processing apparatus according to claim 1, wherein the paper transport path is formed approximately vertically between the paper feed portion and the paper output portion, which are arranged vertically in the apparatus body with the processing portion in between, so as to be arranged by way of one side of the processing portion.

11. The sheet processing apparatus according to claim 10, wherein the processing portion is an image forming portion for forming images on one or both sides of the paper sheet.

12. The sheet processing apparatus according to claim 11, wherein the paper transport path is defined by a gap between a photoreceptor and a transfer device in an image forming portion and a pair of rollers constituting a fixing unit, and the transfer device and one of the rollers constituting the fixing unit are affixed on the side panel cover.

13. A sheet processing apparatus comprising:

a paper feed portion;

a processing portion;

a paper output portion;

a paper transport path defined from the paper feed portion to the paper output portion by way of the processing portion, by components arranged opposing both sides or surfaces of a paper sheet to be transported; and a side panel cover which is integrated with the components opposing one of the paper sheet's surfaces on one side of an apparatus body, being among the components constituting the paper transport path, and wherein the side panel cover is movable in a horizontal direction and a vertical direction relative to the apparatus body.

14. The sheet processing apparatus according to claim 13, wherein the paper transport path includes a primary transport path defined from the paper feed portion to the paper output portion by way of the processing portion by components opposing both sides or surfaces of the paper sheet to be transported and an auxiliary transport path disposed closer to one side of the apparatus body with respect to the primary transport path and defined from the paper output portion to the paper feed portion, by components arranged opposing both sides or surfaces of the paper sheet to be transported; the components opposing the paper sheet's surface on one side of the apparatus body, being among the components constituting the primary transport path and the components constituting the auxiliary transport path are integrated with the side panel cover and are arranged movable horizontally and vertically relative to the apparatus body; and the components opposing the paper sheet's surface on one side of the apparatus body, being among the components constituting the primary transport path and the components opposing the paper sheet's surface on the other side of the apparatus body, being among the components constituting the auxiliary transport path are integrally axially supported at an axle located in a lower end portion.

15. The sheet processing apparatus according to claim 14, wherein the paper transport path is formed approximately vertically between the paper feed portion and the paper output portion, which are arranged vertically in the apparatus body with the processing portion in between, so as to be arranged by way of one side of the processing portion.

16. The sheet processing apparatus according to claim 15, wherein the processing portion is an image forming portion for forming images on one or both sides of the paper sheet.

17. The sheet processing apparatus according to claim 16, wherein the paper transport path is defined by a gap between a photoreceptor and a transfer device in an image forming portion and a pair of rollers constituting a fixing unit, and the transfer device and one of the rollers constituting the fixing unit are affixed on the side panel cover.

18. The sheet processing apparatus according to claim 13, wherein the paper transport path is formed approximately vertically between the paper feed portion and the paper output portion, which are arranged vertically in the apparatus body with the processing portion in between, so as to be arranged by way of one side of the processing portion.

19. The sheet processing apparatus according to claim 18, wherein the processing portion is an image forming portion for forming images on one or both sides of the paper sheet.

20. The sheet processing apparatus according to claim 19, wherein the paper transport path is defined by a gap between a photoreceptor and a transfer device in an image forming portion and a pair of rollers constituting a fixing unit, and the transfer device and one of the rollers constituting the fixing unit are affixed on the side panel cover.

21. A sheet processing apparatus comprising:

a paper feed portion;

a processing portion;

a paper output portion;

a paper transport path defined from the paper feed portion to the paper output portion by way of the processing portion, by components arranged opposing both sides or surfaces of a paper sheet to be transported;

a side panel cover which is integrated with the components opposing one of the paper sheet's surfaces on one side of an apparatus body, being among the components constituting the paper transport path, wherein the side panel cover is adapted to move horizontally with respect to the apparatus body;

wherein the paper transport path is formed approximately vertically between the paper feed portion and the paper output portion, which are arranged vertically in the apparatus body with the processing portion in between, so as to be arranged by way of one side of the processing portion;

wherein the processing portion is an image forming portion for forming images on one or both sides of the paper sheet; and wherein the paper transport path is defined by a gap between a photoreceptor and a transfer device in the image forming portion and a pair of rollers constituting a fixing unit, and the transfer device and one of the rollers constituting the fixing unit are affixed on the side panel cover.

* * * * *